US009506277B2

(12) United States Patent
Lee

(10) Patent No.: US 9,506,277 B2
(45) Date of Patent: Nov. 29, 2016

(54) DOOR LOCKING DEVICE FOR TRUCK

(71) Applicant: Hyundai Motor Company, Seoul (KR)

(72) Inventor: Hyun Woo Lee, Bongdong-Eup (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 324 days.

(21) Appl. No.: 14/097,110

(22) Filed: Dec. 4, 2013

(65) Prior Publication Data

US 2015/0048630 A1 Feb. 19, 2015

(30) Foreign Application Priority Data

Aug. 14, 2013 (KR) ..... 10-2013-0096292

(51) Int. Cl.

| | |
|---|---|
| ***E05C 3/06*** | (2006.01) |
| ***E05C 3/16*** | (2006.01) |
| ***E05B 77/52*** | (2014.01) |
| ***E05B 77/54*** | (2014.01) |
| ***E05B 83/42*** | (2014.01) |
| ***E05B 15/00*** | (2006.01) |

(52) U.S. Cl.

CPC ..... *E05C 3/16* (2013.01); *E05B 15/0093* (2013.01); *E05B 77/52* (2013.01); *E05B 77/54* (2013.01); *E05B 83/42* (2013.01); *Y10T 292/1064* (2015.04)

(58) Field of Classification Search

CPC .... E05B 77/22; E05B 77/00; E05B 15/0093; E05B 15/0046; Y10S 292/23; Y10S 292/22; E05C 3/16; E05C 3/12; B62D 33/07

USPC ..... 292/201, 216; 296/190.05, 190.06

See application file for complete search history.

(56) References Cited

U.S. PATENT DOCUMENTS

| | | | | | |
|---|---|---|---|---|---|
| 2,774,640 | A * | 12/1956 | Harmon | B60N 3/004 | 108/134 |
| 3,930,681 | A * | 1/1976 | Burton | B62D 33/071 | 24/494 |
| 4,536,021 | A * | 8/1985 | Mochida | E05B 77/12 | 292/201 |
| 5,369,843 | A * | 12/1994 | Yu | E05B 65/5292 | 16/343 |
| 5,493,881 | A * | 2/1996 | Harvey | E05B 47/0607 | 292/144 |
| 6,575,508 | B2 * | 6/2003 | Stuart | E05B 77/06 | 292/336.3 |
| 6,802,550 | B1 * | 10/2004 | Griggs, Jr. | B60N 2/4686 | 292/136 |
| 8,152,209 | B2 * | 4/2012 | Lee | E05B 77/06 | 292/336.3 |
| 2001/0035656 | A1 * | 11/2001 | Stuart | E05B 77/06 | 292/347 |
| 2004/0046400 | A1 * | 3/2004 | Drysdale | E05B 77/06 | 292/216 |

(Continued)

FOREIGN PATENT DOCUMENTS

| | | | |
|---|---|---|---|
| EP | 1081063 | * | 3/2001 |
| JP | 10-30371 A | | 2/1998 |

(Continued)

*Primary Examiner* — Janet M Wilkens

(74) *Attorney, Agent, or Firm* — Morgan, Lewis & Bockius LLP

(57) ABSTRACT

A device is capable of preventing a door and a user from being damaged by automatically locking the door during a cab tilting of a truck. An automatic door locking device having a new shape in which a locked state of the door can be forcibly maintained in a cab tilted state by an associated operation between a weight and a key lever when the cab is tilted, is implemented so that door unlocking when the cab is tilted cannot be performed and thus damage of the cab caused by opening of the door and user injury can be prevented.

6 Claims, 18 Drawing Sheets

(56) References Cited

U.S. PATENT DOCUMENTS

2007/0024068 A1* 2/2007 Wood ..... E05B 77/06 292/336.3
2007/0029835 A1* 2/2007 Herline ..... E05B 77/04 296/146.1
2007/0296226 A1* 12/2007 Gruber ..... B62D 33/037 292/216
2008/0023971 A1* 1/2008 Akizuki ..... E05B 77/26 292/201
2011/0133492 A1* 6/2011 Perkins ..... E05B 77/26 292/216
2014/0070550 A1* 3/2014 Michael ..... E05C 3/24 292/226
2014/0224806 A1* 8/2014 Michael ..... E05B 15/0093 220/324
2016/0060898 A1* 3/2016 Michael ..... E05B 15/0093 292/200

FOREIGN PATENT DOCUMENTS

JP 2003-320851 A 11/2003
KR 2003-0050270 A 6/2003
KR 20070039216 * 4/2007

* cited by examiner

DETAIL "A"

DETAIL "A" (REAR SIDE)

WHILE CAP TILT'G IS PERFORMED

WHEN CAB TITL'G IS COMPLETED

DETAIL "A"

DETAIL "A" (REAR SIDE)

DR LATCH (CONVENTIONAL STRUCTURE)

DETAIL "A"

DOOR LOCKING DEVICE FOR TRUCK

CROSS-REFERENCE TO RELATED PATENT APPLICATION

The present application claims priority of Korean Patent Application Number 10-2013-0096292 filed Aug. 14, 2013, the entire contents of which application is incorporated herein for all purposes by this reference.

BACKGROUND OF INVENTION

Field of Invention

The present invention relates to a door locking device for a truck, and more particularly, to a device that is capable of preventing a door from being damaged and a user from being injured by automatically locking the door when a cab of the truck is tilted.

Description of Related Art

In general, in a cab tilting structure for a truck, a chassis and a cab are connected to each other, vibration transmitted from the chassis during a drive is absorbed to control the movement of the cab such that ride comfort is determined and the cab is tilted when servicing is performed.

For example, in a medium and large size truck, main devices for a vehicle, such as an engine and a transmission, are placed at a lower part of the cab. Thus, when servicing is performed, the cab is tilted in a forward direction of the vehicle due to an action of a hydraulic cylinder.

In medium and large sized trucks, the cab is supported by four air springs so as to improve ride comfort. Thus, a cushion action caused by a vertical movement of the springs is always applied to the cab during the drive.

A door for the medium and large size truck is configured in such a way that a key lever ascends and descends due to an acting force of a latch actuator and a key load and locking/unlocking operations can be performed.

For example, as illustrated in FIGS. 7A and 7B, locking/unlocking of a door is performed as a key lever 110 ascends and descends due to an acting force of a latch actuator and a key load 100.

That is, when the key lever 110 ascends, a door-unlocked state is established, and when the key lever 110 descends, a door-locked state is established.

However, current cars are not equipped with an additional safety device that prevents doors from being opened after cab tilting. Thus, there is a high risk that the cab will be damaged by door free drop and a user will be injured when the door is opened after cab tilting due to a user's carelessness.

That is, since the door can be opened in a cab tilted state, there is a high risk that the door will freely drop by its own weight when the door is opened after cab tilting is performed, the cab will be damaged and the user will be injured due to a user's carelessness.

In this consideration, Japanese Patent Application Publication No. 2003-320851 and Korean Patent Application Publication No. 2003-50270, and Japanese Patent Application Publication No. 1998-30371 disclose safety devices relating to locking/unlocking of a door. However, no safety device relating to a cab tilted state has been proposed.

The information disclosed in this Background section is only for enhancement of understanding of the general background of the invention and should not be taken as an acknowledgement or any form of suggestion that this information forms the prior art already known to a person skilled in the art.

BRIEF SUMMARY

The present invention provides a door locking device for a truck having a new structure in which a locked state of a door can be forcibly maintained in a cab tilted state through an associated operation between a weight and a key lever when a cab is tilted so that a door-locked state cannot be released when the cab is tilted, the cab can be prevented from being damaged due to opening of the door and a user can be prevented from being injured.

According to an aspect of the present invention, there is provided a door locking device for a truck, the door locking device including: a key lever that locks/unlocks a door while being rotated by an operation of a key load; a lock lever, that is supported in a coaxial structure with the key lever, is rotatable and releases combination between the key lever and the key load through contact with the key load; and a weight that is coupled to one side of the lock lever and rotates the lock lever using its own weight when a cab is tilted.

An interlocking relationship between the key load and the key lever may be ended through the weight and the lock lever in the cab tilted state so that opening of the door can be prevented.

A stopper that is able to be hung in the lock lever in a state in which the lock lever and the key load contact each other, may be provided at a rear side of the key lever so that the lock lever and the key lever are together rotated in a state in which combination between the key lever and the key load is released and the key lever is placed in a locked state.

The stopper provided at the key lever may be of a type of a pocket that accommodates a part of the lock lever.

The door locking device may further include a return spring that is interposed between axial parts of the key lever and the lock lever, has one end supported at the key lever and the other end supported at the cab and restores the key lever when the cab is tilted down, and a lever guide, a side of which is connected to a part in which the weight is coupled to the lock lever through a slot and the other side of which is coupled to a latch assembly in a pin structure and which guides a rotation trajectory of the lock lever while being together rotated when the lock lever is rotated.

The key load may be configured to be inserted into An aperture formed in the key lever through an end of the key load and to be combined with the key lever, to interlock together with the key lever and to be supported by a key load clip and a key load spring that are movable along a slide groove of the key lever.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
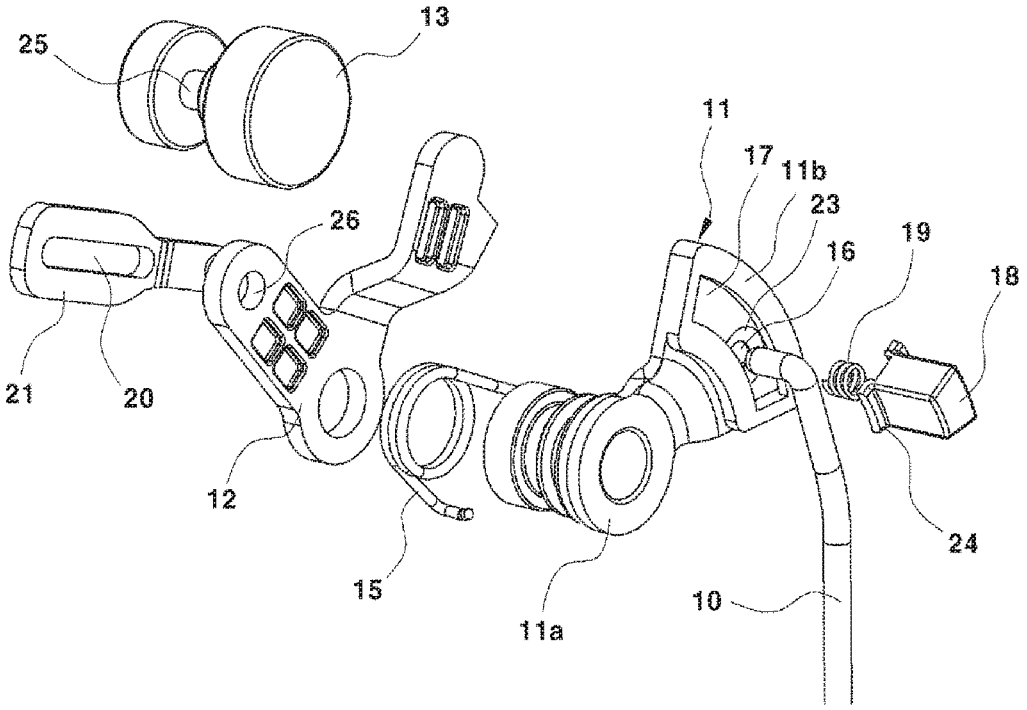
FIG. 1 is a perspective view of an exemplary door locking device according to the present invention.
Figure 2A:
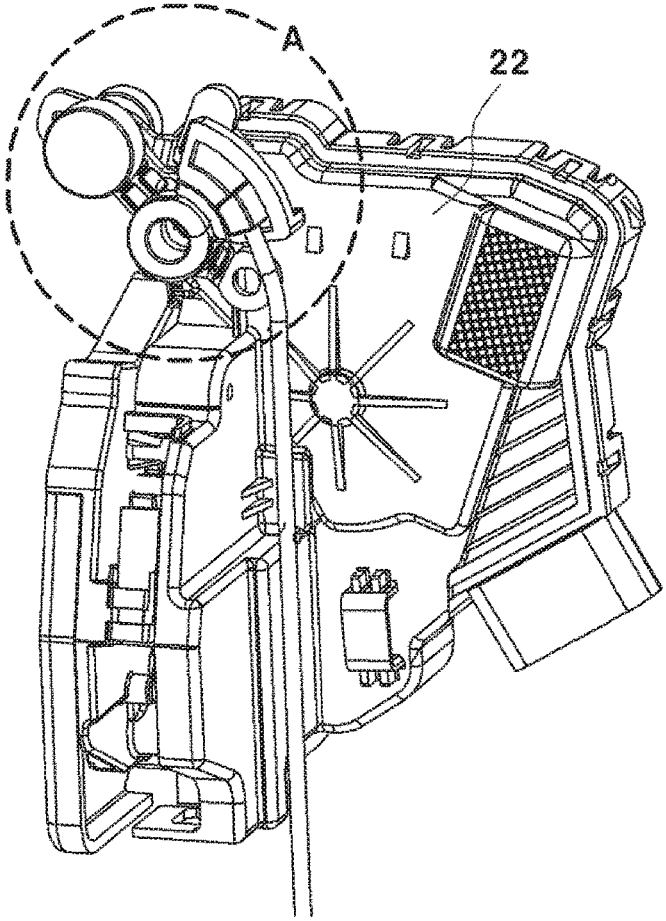
FIGS. 2A and 2B are perspective views illustrating a state in which the door locking device illustrated in FIG. 1 is installed.
Figure 2B:
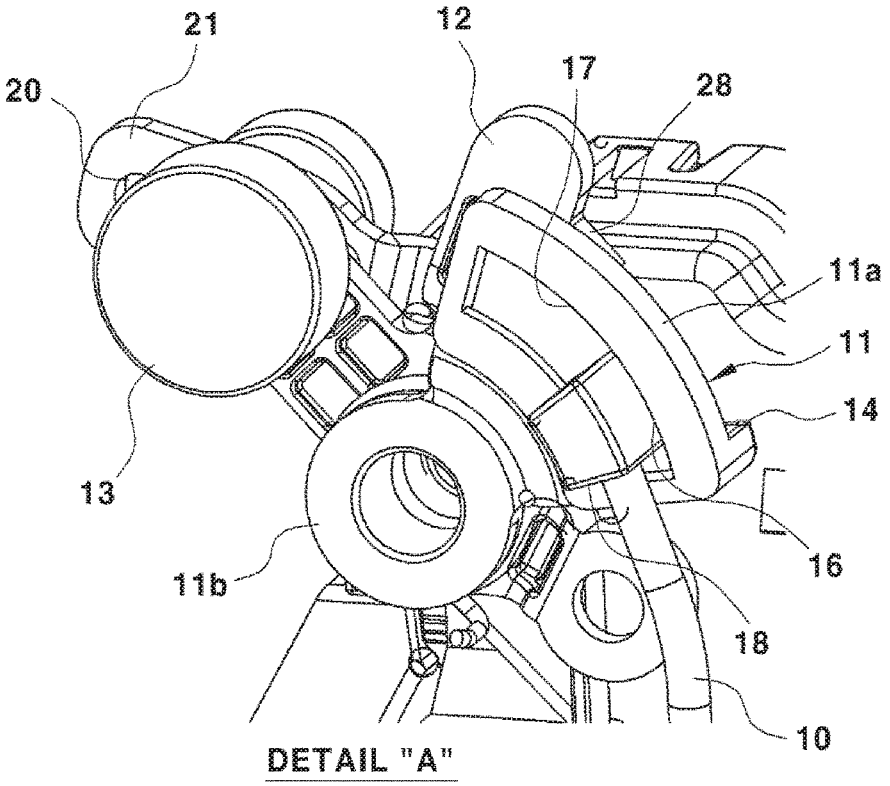

FIG. 1 is a perspective view of a door locking device according to various embodiments of the present invention, and FIGS. 2A and 2B are perspective views illustrating a state in which the door locking device illustrated in FIG. 1 is installed.

As illustrated in FIGS. 1 and 2A and 2B, the door locking device is configured in such a way that a door is automatically locked using a combination of a weight, a key lever, and a lock lever that are interlocked with one another when a cab is tilted and the door is prevented from being opened.

To this end, a key lever 11 is provided to operate a latch assembly that locks/unlocks the door, i.e., performs door locking/unlocking while being rotated by an operation of a key load 10 that extends from a key set of a door outside handle.

For example, when the key lever 11 is rotated counterclockwise in the drawings due to the key load 10, the latch assembly in this case is in an unlocked state. Conversely, when the key lever 11 is rotated clockwise in the drawings due to the key load 10, the latch assembly in this case is in a locked state.

An operation in which the latch assembly is converted into the locked or unlocked state in association with rotation of the key lever 11 is the same as that of the related art. Thus, a detailed description thereof will be omitted.

The key lever 11 includes an integrated type of a boss part 11*b* that serves as a rotation center body and a lever part 11*a* connected to the key load 10. The key lever 11 is installed at a shaft installed at a side of a latch assembly cover 22 via the boss part 11*b* and can be rotated around the shaft.

An aperture 16 through which the lever part 11*a* of the key lever 11 is connected to the key load 10, is formed in the lever part 11*a* of the key lever 11, and a slide groove 17 is formed to have an arc-shaped trajectory around a vicinity of the aperture 16.

A vicinity of the aperture 16, i.e., a vicinity of the aperture 16 on a bottom surface of the slide groove 17 includes an inclined surface 23, a diameter of which increases as it gets closer to an outer side from a center of the aperture 16. The key load 10 is induced along the inclined surface 23 so that combination with the key cover 11 can be released.

A key load clip 18 that will be described below can be slidably coupled to the slide groove 17 formed in the lever part 11*a* of the key lever 11.

A stopper (see 14 of FIG. 3C) that may be hung in a lock lever 12 that will be described below is formed at a rear side of the lever part 11*a* of the key lever 11. The lock lever 12 is hung in the stopper 14 in a state in which the lock lever 12 and the key load 10 contact each other, i.e., in a state in which the lock lever 12 pushes the key load 10. Thus, when the lock lever 11 is rotated together with rotation of the lock lever 12, the key load 10 in this case is not combined with the key lever 11 and thus does not move together.

The stopper 14 formed at the key lever 11 has a pocket type, opened upper part. The stopper 14 is configured to accommodate a part of the lock lever 12 such that the lock lever 12 and the key lever 11 can be stably hung in the stopper 14.

In particular, the lock lever 12 is provided to be supported in a coaxial structure with the key lever 11 and to be rotatable and simultaneously to release the combined state of the key lever 11 and the key load 10 through contact with the key load 10.

The lock lever 12 includes two lever pieces having approximately a "V" shape. The lock lever 12 is installed at the boss part 11*b* of the key lever 11 through An aperture formed in a central part (a V-shaped vertex part) in which two lever pieces meet each other so that the lock lever 12 can be freely rotated.

A pine aperture 26 is formed in an end of one lever piece of the lock lever 12 so that a weight 13 that will be described below can be coupled through the pine aperture 26. A protrusion part 28 is formed at a side of an end of the other lever piece of the lock lever 12 so that the protrusion part 28 can be accommodated in and hung in the stopper 14 formed at the key lever 11.

In particular, one of two lever pieces of the lock lever 12, i.e., a lever piece in which the protrusion part 28 is formed, has a shape in which a middle part of a length of the lever piece is bent. Thus, the lever piece in this case closely contacts a rear side of the lever part 11*a* of the key lever 11.

The weight 13 is substantially provided as a unit for rotating the lock lever 12. The weight 13 in this case is coupled to one side of the lock lever 12 so as to rotate the lock lever 12 using its own weight when the cab is tilted.

That is, the weight 13 includes two disc-shaped masses and a pin part 25 that connects centers of two disc-shaped masses. The weight 13 is configured to be inserted into the pine aperture 26 formed in one lever piece of the lock lever 12 through the pin part 25 and to be coupled to the lock lever 12.

Thus, when the cab is leaned in one direction when the cab is tilted, the weight 13 in this case is also leaned in the same direction. The lock lever 12 can also be rotated by the weight of the weight 13 itself leaned in this way.

Also, a return spring 15 is provided as a unit for returning the key lever 11 to its initial position when the cab is tilted down (is restored).

The return spring 15 is installed to be wound around the boss part 11*b* of the key lever 11. One end of the return spring 15 installed in this way is hung in and supported at one side of the key lever 11 and simultaneously, the other end of the return spring 15 is fixed to a side of the cab, i.e., one side of the latch assembly cover 22.

Thus, a force to rotate in an unlocking direction, i.e., counterclockwise is always applied to the key lever 11 due to an elastic force of the return spring 15. As a result, the key lever 11 can be returned to its original position in a state in which a force to pressurize downwards caused by the weight 13 and the lock lever 12 is removed from the key lever 11. In this return state, the key load 10 is inserted into the aperture 16 of the key lever 11 such that the key load 10 can be combined with the key lever 11.

The key load 10 is configured to be supported by the key load clip 18 and a key load spring 19 and can be connected to the key lever 11.

To this end, the rectangular case-shaped key load clip 18 having wing parts 24 and the key load spring 19 that is placed inside the key load clip 18 and elastically supports the key load 10, are provided at a lower end of the key load 10.

The key load clip 18 is configured to accommodate an end of the key load 10 in the key load clip 18 and to be inserted into the slide groove 17 formed in the lever part 11*a* of the key lever 11 using both wing parts 24. The key load spring 19 serves to push the end of the key load 10 toward a front side of the key lever 11 inside the key load clip 18.

Thus, the key load 10 is inserted into the aperture 16 of the key lever 11 due to a force of the key load spring 19, is maintained in a combined state with the key lever 11 and is interlocked with the key lever 11.

When the combination state with the key lever 11 is released by the lock lever 12, the key load 10 is relatively movable along the slide groove 17 together with the key load clip 18 when the key lever 11 is rotated.

A lever guide 21 is provided as a unit for guiding a rotation trajectory of the lock lever 12.

The lever guide 21 has the shape of a bar having a slot 20 at one end thereof and a guide pin (see 27 of FIG. 3C) at the other end thereof.

The lever guide 21 is configured to be supported at a side of the latch assembly, i.e., at the latch assembly cover 22 using the guide pin 27 at the other end thereof, to be installed to be rotatable around the guide pin 27 and to be inserted into the pine aperture 26 of the lock lever 12 into which the pin part 25 of the weight 13 is inserted, using the slot 20 at one end thereof.

Thus, as the lock lever 12 and the weight 13 are combined with the slot 20 of the lever guide 21 that is together rotated around the guide pin 27 at the latch assembly when the lock lever 12 is rotated, the lock lever 12 can be guided along the rotation trajectory without leaving.

Thus, an operating state of the door locking device for the truck having the above structure will now be described below.

FIGS. 3A through 6C are perspective views illustrating an operating state of the door locking device of FIG. 1.

Figure 3A:
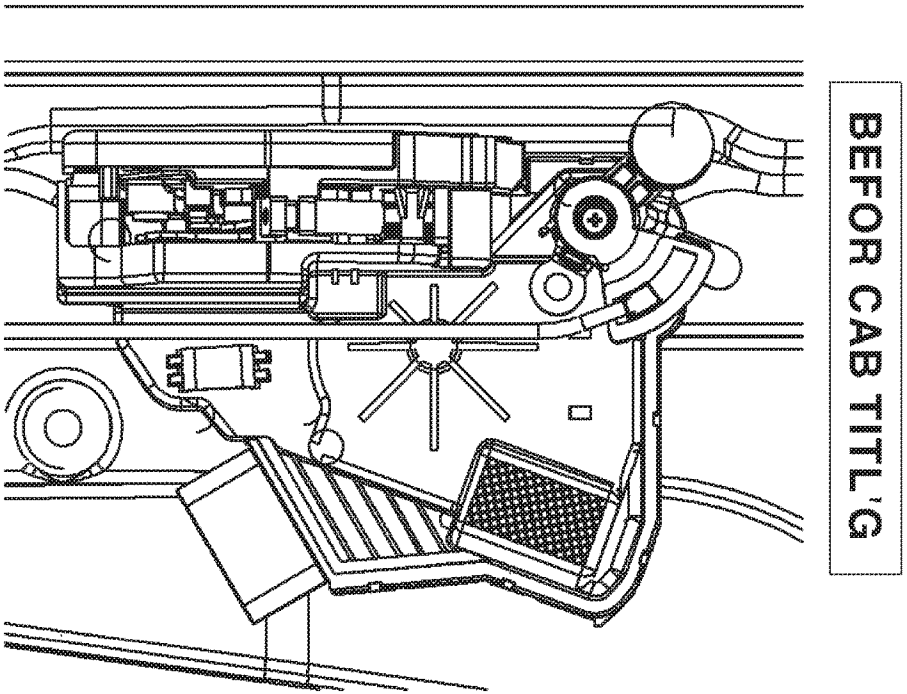
FIGS. 3A, 3B and 3C are views illustrating an operating state of the door locking device of FIG. 1.
Figure 3B:
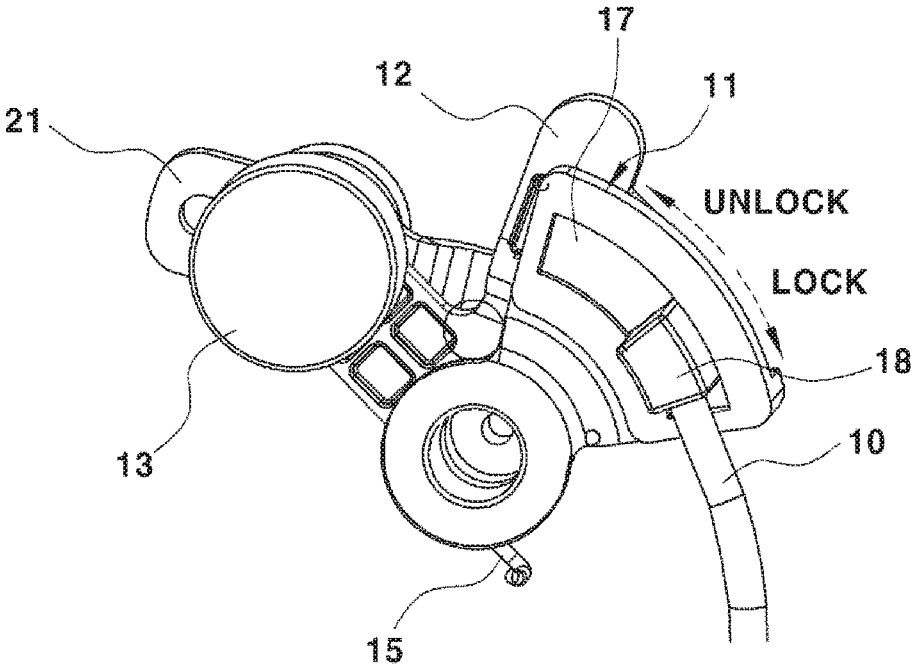
Figure 3C:
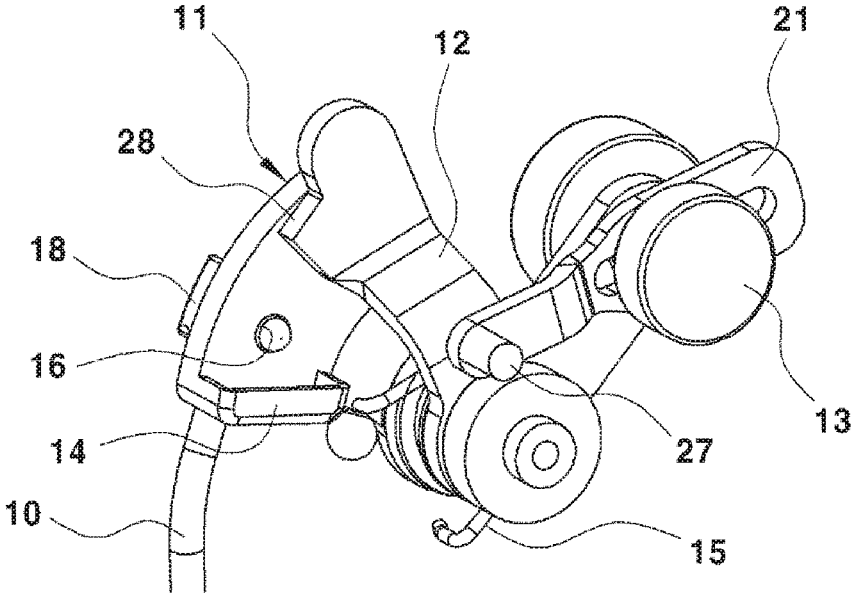
Figure 4A:
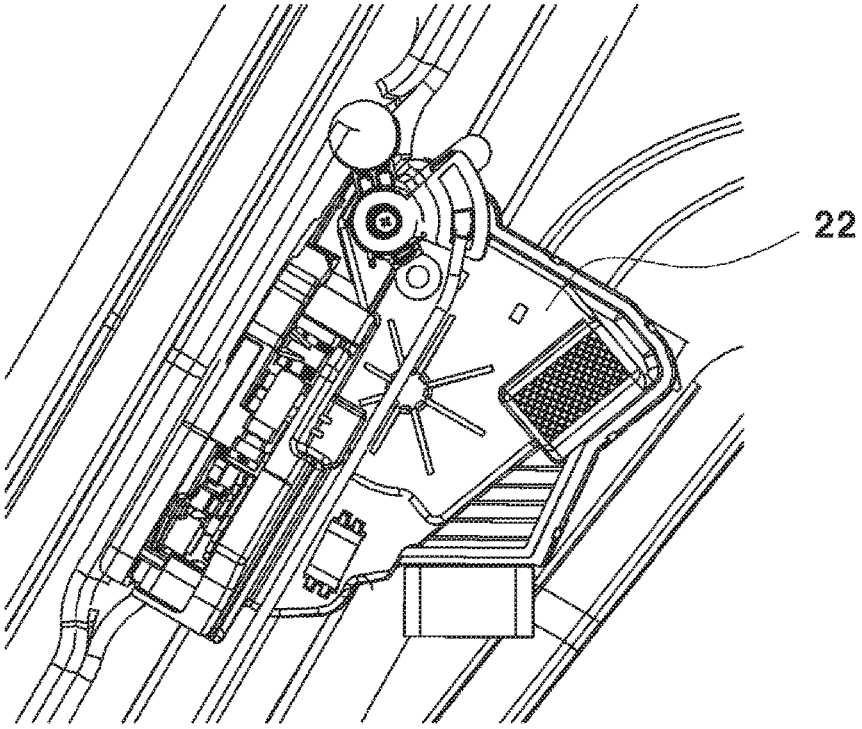
FIGS. 4A, 4B, 4C and 4D are further views illustrating an operating state of the door locking device of FIG. 1.
Figure 4B:
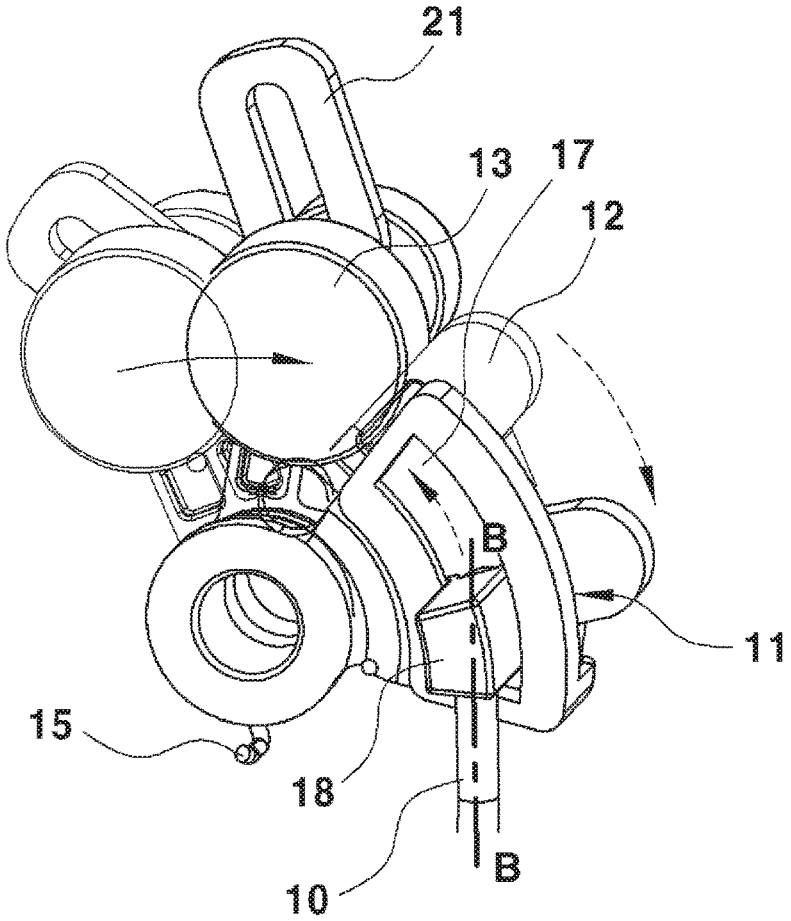
Figure 4C:
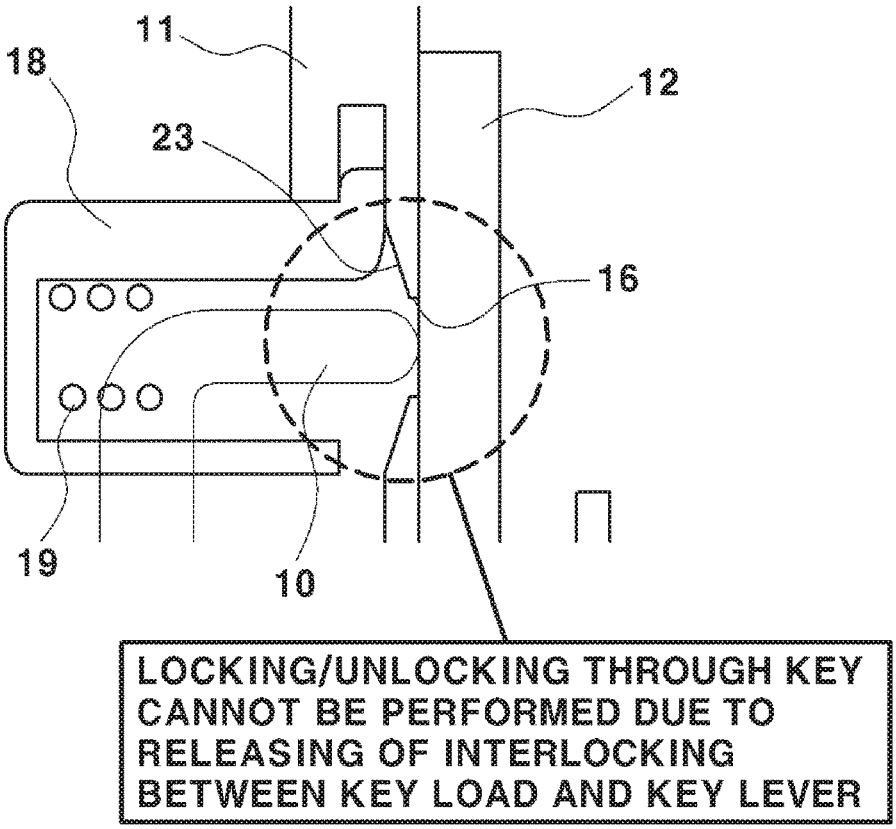
Figure 4D:
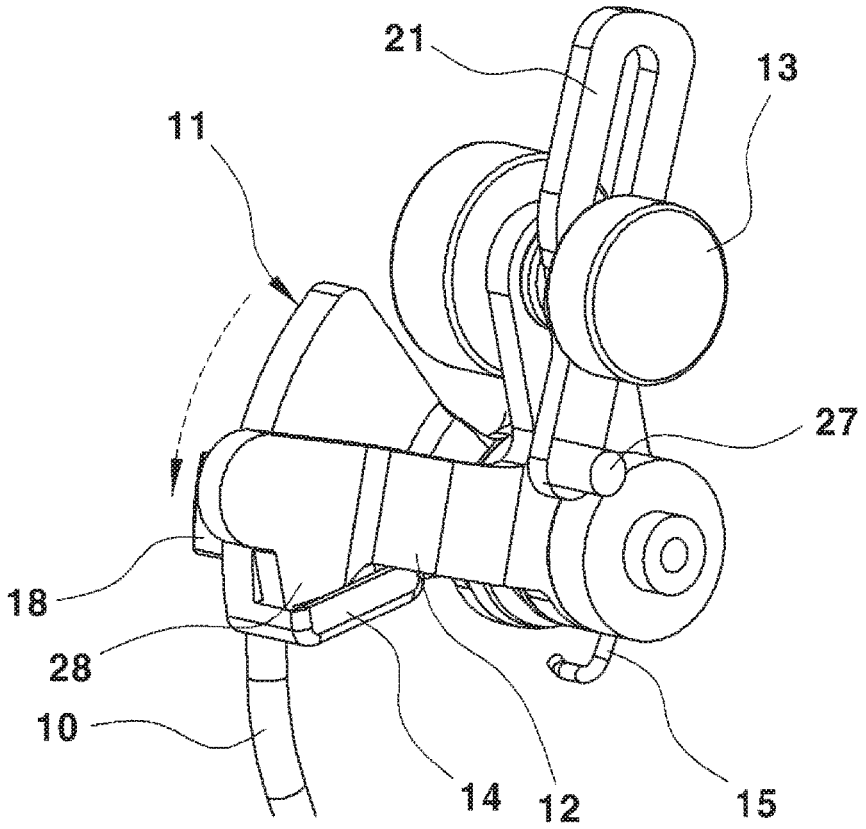

As illustrated in FIGS. 3A through 3C, in a state in which cab tilting is not performed (before cab tilting), the key load 10 is maintained in a state in which the key load 10 is inserted into the aperture 16 of the key lever 11 and is combined with the key lever 11. The lock lever 12 in this case is maintained to be spaced apart from the key lever 11 by a predetermined angle due to the weight 13.

In this case, when a user manipulates a key, the key lever 11 is rotated clockwise or counterclockwise due to the movement of the key load 10. As a result, the latch assembly is locked or unlocked so that opening/closing of the door can be performed.

As illustrated in FIGS. 4A through 4D, while cab tilting is performed, when the cab is leaned, the weight 13 is inclined in a direction in which the cab is leaned, the lock lever 12 is rotated by the weight of the weight 13 itself, and the lock lever 12 rotated in this way closely contacts a rear side of the key lever 11 and is rotated such that an end of the key load 10 inserted into the aperture 16 of the key lever 11 is pushed toward the front side of the key lever 11.

In this way, when the end of the key load 10 escapes from the aperture 16, the combination structure with the key lever 11 is released, an interlocking structure between the key lever 11 and the key load 10 is released, and the protrusion part 28 of the lock lever 12 is seated within and hung in the stopper 14 of the key lever 11.

Figure 5A:
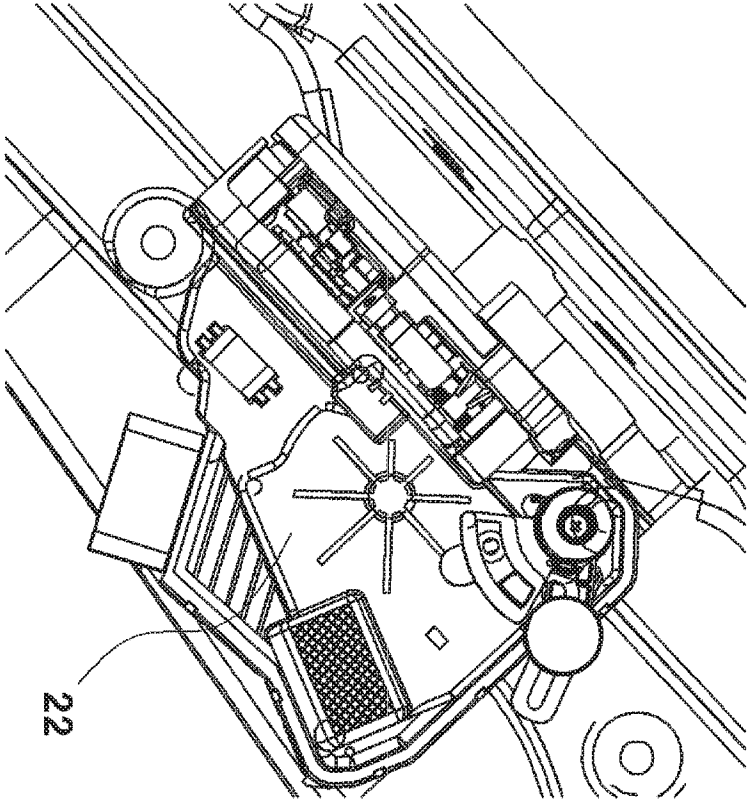
FIGS. 5A, 5B and 5C are still further views illustrating an operating state of the door locking device of FIG. 1.
Figure 5B:
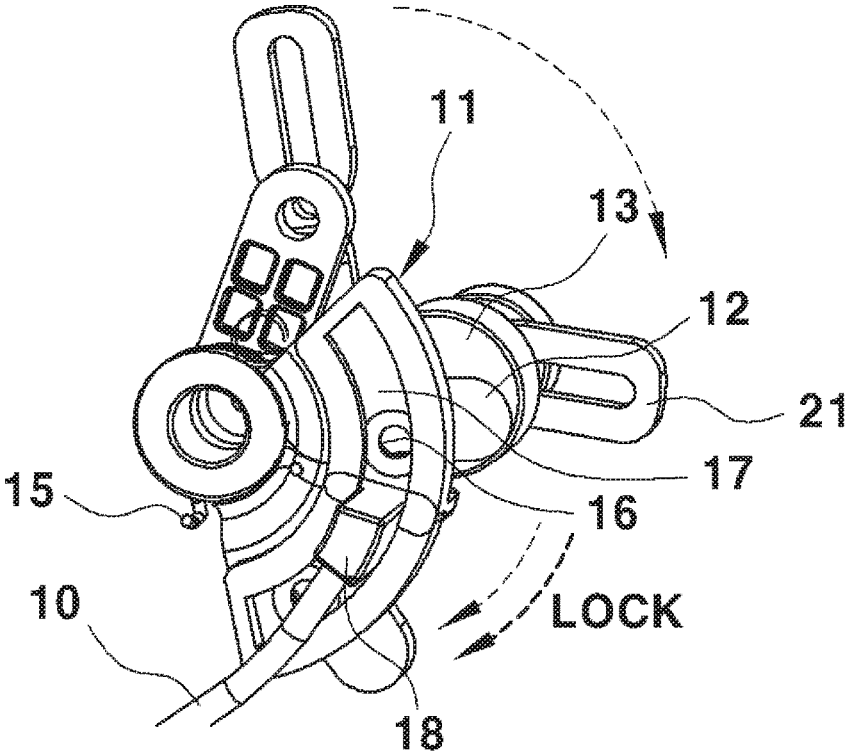
Figure 5C:
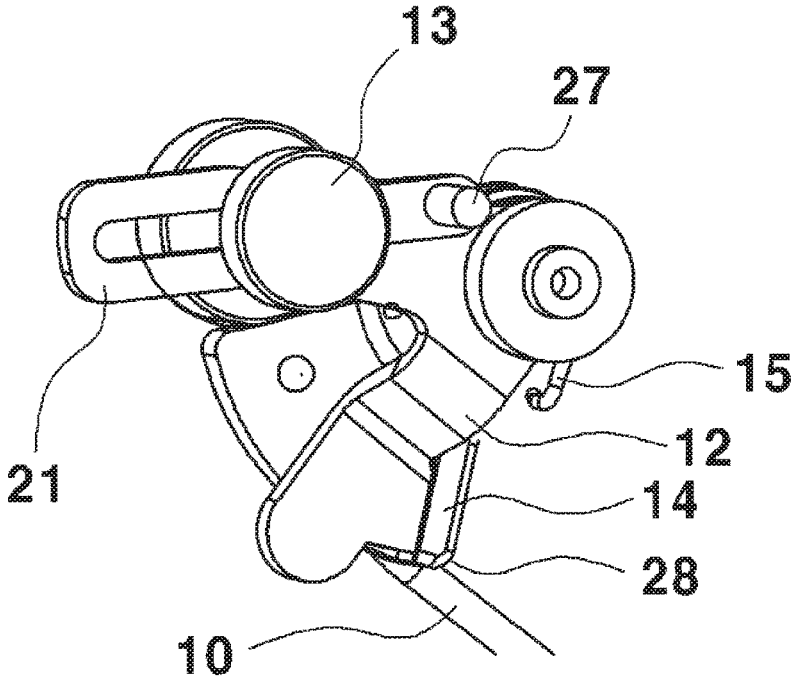

As illustrated in FIGS. 5A through 5C, when cab tilting is completed, if the cab is fully leaned, due to the weight of the weight 13 itself, the lock lever 12 and the key lever 11 hung in the stopper 14 are rotated clockwise (locking direction), and as the key lever 11 is rotated, the latch assembly is in a locked state, and the door is not opened.

In this case, even when the user moves the key load 10 by manipulating the key, since the combination structure with the key lever 11 is released, the key load 10 is moved along the slide groove 17 of the key lever 11 and performs a vain operation. Thus, a door-locked state (latch assembly-locked state) can be safely maintained.

That is, in a cab tilted state, door unlocking cannot be performed outside a vehicle.

Figure 6A:
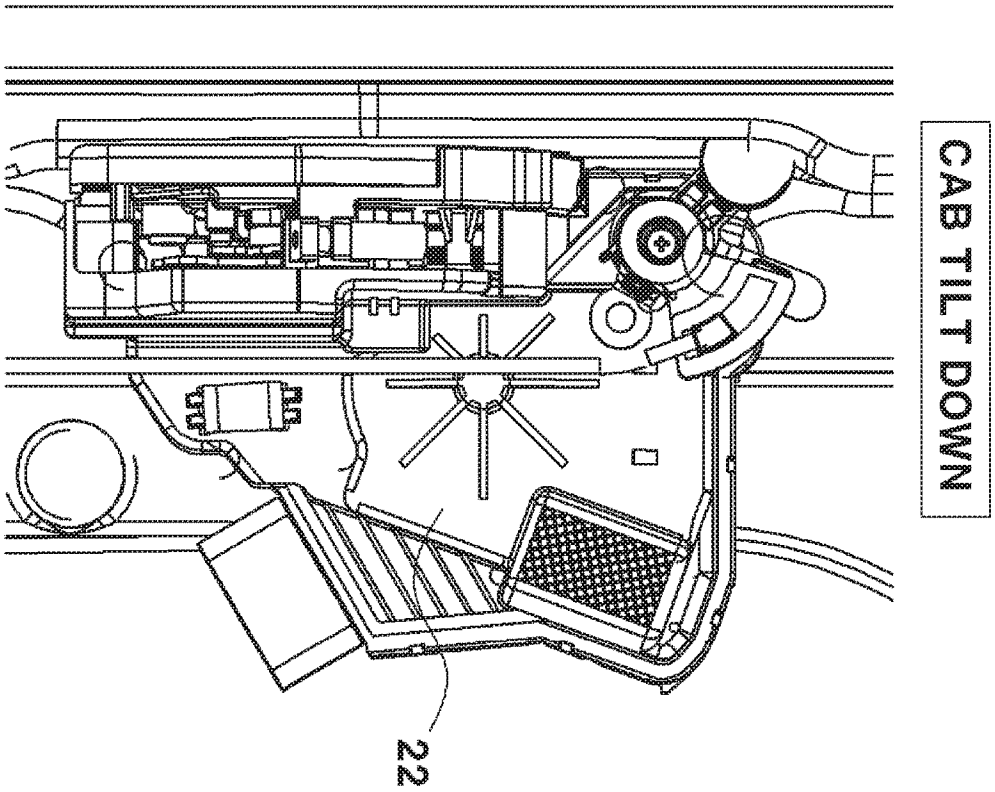
FIGS. 6A, 6B and 6C are even further views illustrating an operating state of the door locking device of FIG. 1.
Figure 6B:
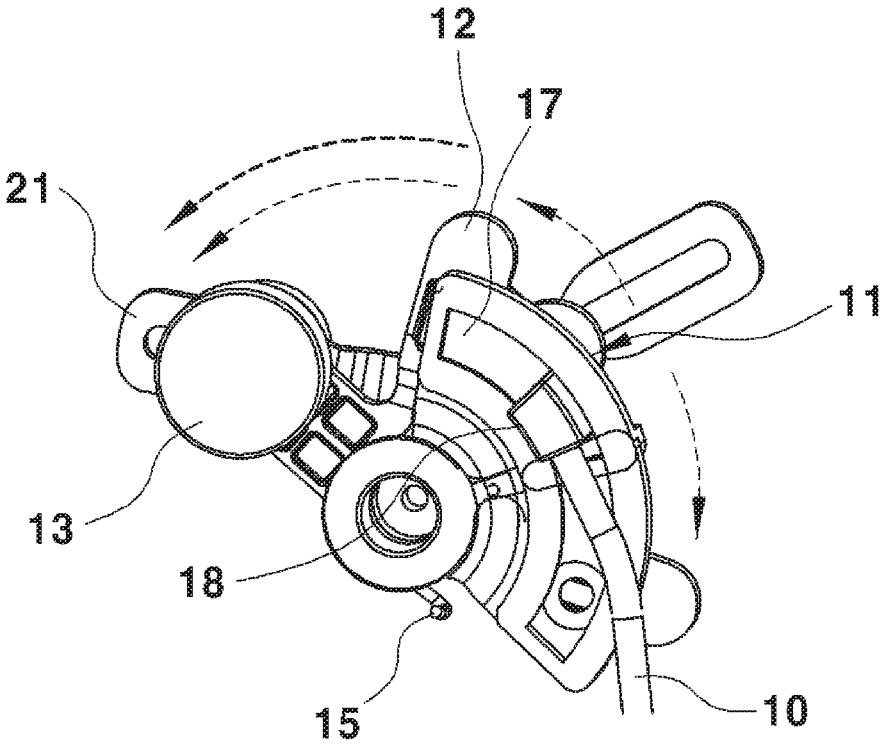
Figure 6C:
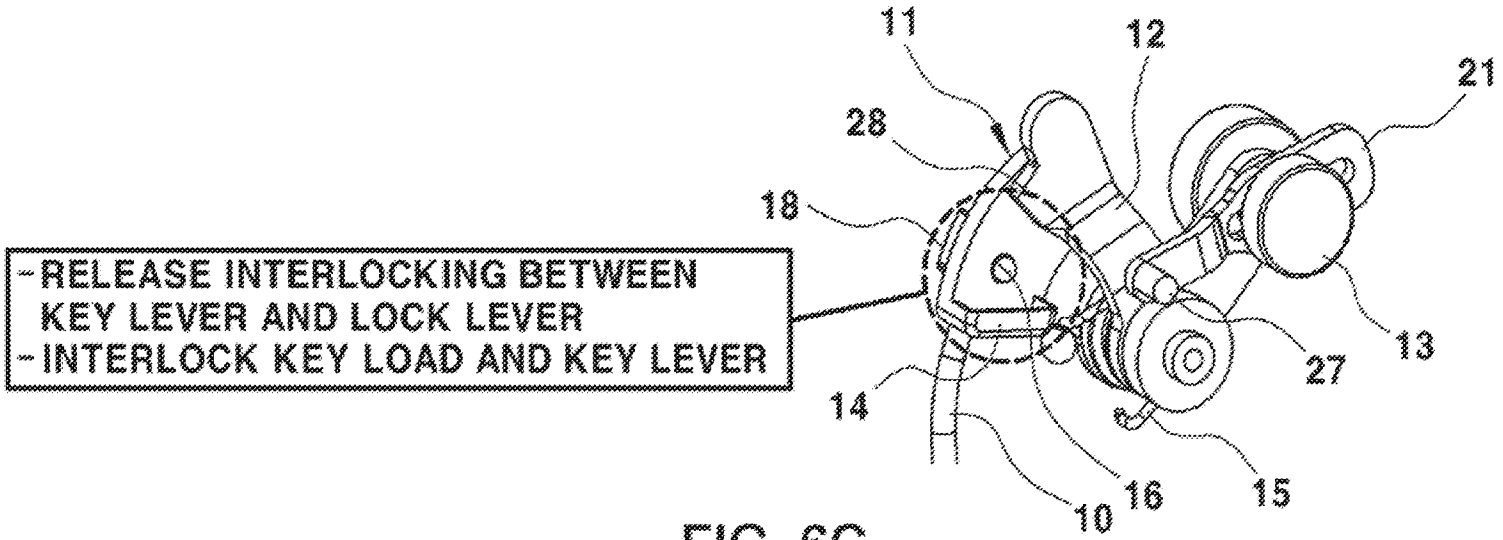
Figure 7A:
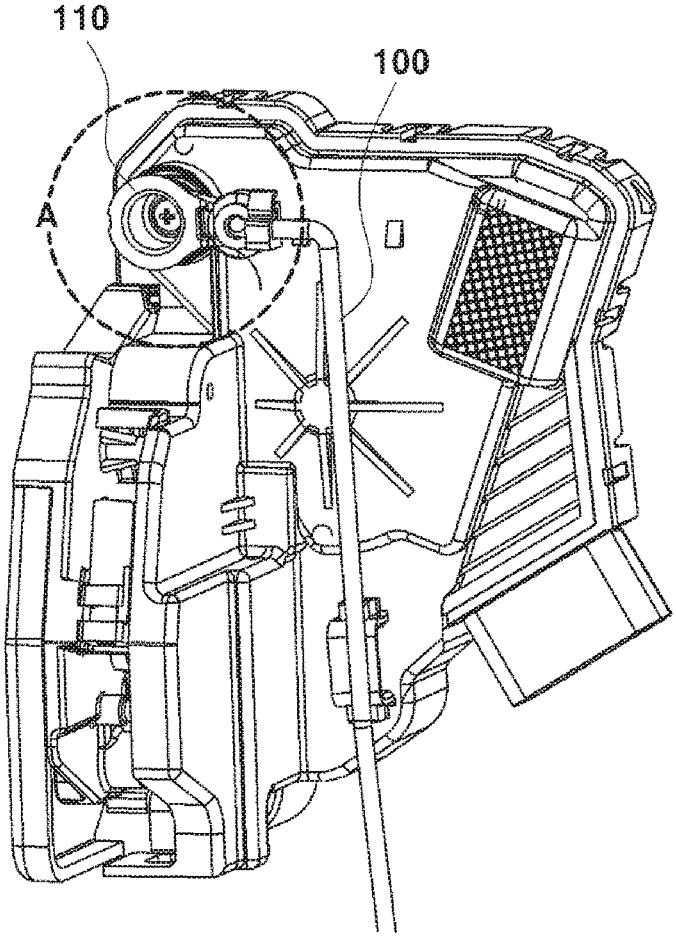
FIG. 7A (RELATED ART)
FIGS. 7A and 7B are perspective views of a door locking device according to the related art.
Figure 7B:
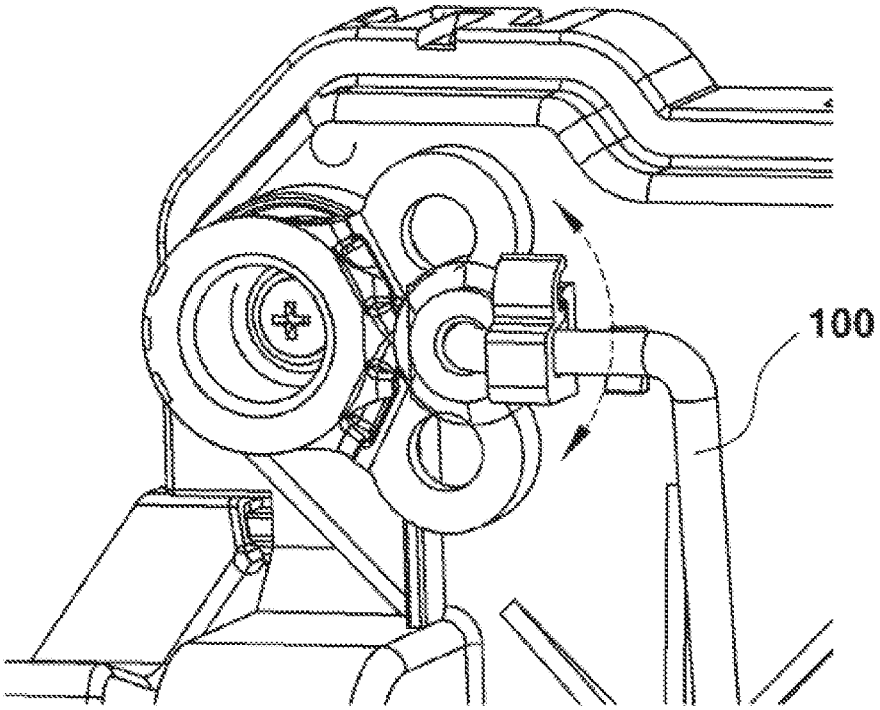
FIG. 7B (RELATED ART)

As illustrated in FIGS. 6A through 6C, in a cab tilted down state, when the cab is returned to its original state, the weight 13 and the lock lever 12 are rotated counterclockwise and are returned to its original position, the key lever 11 in this case is rotated counterclockwise (unlocking direction) due to a restoring force of the pressurized return spring 15, and the key load 10 is again inserted into the aperture 16 of the key lever 11 so that a combination structure with the key lever 11 can be established.

Thus, the combination state between the key load 10 and the key lever 11 is recovered, the key lever 11 can be rotated due to an operation of the key load 10 through user's key manipulation, and the door can be locked or unlocked through rotation of the key lever 11.

In this way, according to various embodiments of the present invention, since, in a cab tilted state, door unlocking cannot be performed due to an operation of a weight and a lock lever, damage of a vehicle caused by opening of a door and user injury can be prevented, and since, in a cab tilted down state, door locking or unlocking can be performed through key manipulation by releasing interlocking between a key lever and the lock lever, the door can be normally opened/closed.

As described above, in a door locking device for a truck according to various embodiments of the present invention, by using a combination of a weight and a key lever that operate in association with a tilting operation of a truck cab and a lock lever, a door-locked state can be automatically forcibly maintained when the truck cab is tilted so that opening of a door can be prevented in the cab tilted state, damage of the truck cab or door can be prevented and a user can be prevented from being injured.

For convenience in explanation and accurate definition in the appended claims, the terms upper or lower, front or rear, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A door locking device for a vehicle, the door locking device comprising:

a key lever having an aperture and locking or unlocking a door according to an operation of a key load;

a lock lever, coaxially supported with the key lever, and rotatable with respect to the key lever;

a weight member coupled to a first side of the lock lever and rotating the lock lever using a weight of the weight member when the weight member is tilted, wherein an end of the key load is selectively inserted into and engaged to the aperture of the key lever, and the end of the key load is configured to escape from the aperture by the lock lever rotated by the weight member, thereby a combined state between the key lever and the key load is released, and an interlocking relationship between the key load and the key lever is ended through the weight member and the lock lever during the tilting of the weigh member so that opening of the door is prevented.

2. The door locking device of claim 1, wherein a stopper that is able to be hung in the lock lever in a state in which the lock lever and the key load contact each other, is provided at a rear side of the key lever so that the lock lever and the key lever are together rotated in a state in which combination between the key lever and the key load is released and the key lever is placed in a locked state.

3. The door locking device of claim 2, wherein the stopper provided at the key lever is a pocket accommodating a part of the lock lever.

4. The door locking device of claim 1, further comprising a return spring interposed between axial parts of the key lever and the lock lever, having a first end supported at the key lever and a second end configured to be supported at a vehicle body and is configured to restore the key lever when the vehicle body is tilted down.

5. The door locking device of claim 1, wherein the key load is configured to interlock together with the key lever and to be supported by a key load clip and a key load spring that are movable along a slide groove of the key lever.

6. The door locking device of claim 1, further comprising a lever guide, a first side of which is connected to a part in which the weight member is coupled to the lock lever through a slot and a second side of which is coupled to a latch assembly in a pin structure and which guides a rotation trajectory of the lock lever while being together rotated when the lock lever is rotated.

* * * * *